US005161881A

United States Patent [19]

Myson

[11] Patent Number: 5,161,881

[45] Date of Patent: Nov. 10, 1992

[54] LAMP HOLDERS

[75] Inventor: Robert E. Myson, Jersey, United Kingdom

[73] Assignee: Luminaire Developments Limited, United Kingdom

[21] Appl. No.: 640,299

[22] PCT Filed: Jun. 28, 1989

[86] PCT No.: PCT/GB89/00720

§ 371 Date: Jan. 24, 1991

§ 102(e) Date: Jan. 24, 1991

[87] PCT Pub. No.: WO89/12381

PCT Pub. Date: Dec. 28, 1989

[30] Foreign Application Priority Data

Jun. 29, 1988 [GB] United Kingdom ..... 8815471
Mar. 13, 1989 [GB] United Kingdom ..... 8905700

[51] Int. Cl.[5] ..... F21V 21/00

[52] U.S. Cl. ..... 362/249; 362/252; 362/806; 439/418

[58] Field of Search ..... 439/417, 418, 425, 426; 362/249, 391, 252, 226, 806

[56] References Cited

U.S. PATENT DOCUMENTS

| | | | |
|---|---|---|---|
| 2,636,069 | 4/1953 | Gilbert | 439/417 |
| 2,692,374 | 10/1954 | Carson | 439/425 |
| 2,749,527 | 6/1956 | Gast | 439/425 |
| 2,884,555 | 4/1959 | Peterson | 439/425 |
| 3,253,137 | 5/1966 | Richter, III | 439/425 |
| 4,667,276 | 5/1987 | Cheng | 362/249 |
| 4,763,232 | 8/1988 | Woodside | 362/391 |
| 4,777,573 | 10/1988 | Liao | 362/249 |
| 4,934,953 | 6/1990 | Tenham et al. | 439/417 |
| 4,944,689 | 7/1990 | Carr | 439/417 |

FOREIGN PATENT DOCUMENTS

| | | | |
|---|---|---|---|
| 268421 | 2/1969 | Austria | 439/425 |
| 986606 | 3/1965 | Fed. Rep. of Germany | 362/391 |

*Primary Examiner*—Ira S. Lazarus
*Assistant Examiner*—Y. Quach
*Attorney, Agent, or Firm*—Gunn, Lee & Miller

[57] ABSTRACT

A festoon lamp holder has a base provided with recesses either side of probes. A cap permanently fits to the base to provide a water-tight seal with an electrical cable passing in use through the holder. Power is provided from the cable conductors via feed-throughs for a bulb. A globe surrounds the bulb and provided with seals forms a gas-tight chanber for the bulb.

9 Claims, 5 Drawing Sheets

LAMP HOLDERS

BACKGROUND OF THE INVENTION

This invention relates to lamp holders and festoon lighting systems.

The invention relates more particularly to lamp holders of the kind used in festoon lighting systems, which can be fixed at selected points along a length of electrical supply cable. The holders incorporate probes which penetrate the insulation of the cable to make contact with the conductors of the cable as required. Such holders are usually formed in two or more principal body parts which screw together to clamp the holder firmly to the cable and simultaneously hold the probes in contact with the cable conductors through penetration points in the cable insulation.

Presently used lamp holders available for low voltage supplies, usually 12 or 24 volts, and for mains voltage supplies, usually 110 volts or 230 and 240 volts, suffer from various disadvantages but are especially vulnerable to water ingress causing corrosion and premature failure in use. Further, removal or shifting of the holder along the line normally leaves bared connectors which can corrode and can be dangerous.

SUMMARY OF THE INVENTION

According to one aspect of the invention there is provided a lamp holder comprising a base, incorporating a lamp socket, having upstanding probes electrically connected to the lamp socket and formed with two opposing recesses, one at each side of the probes, shaped to receive an insulated electrical supply cable which extends beyond the recesses and across the probes in use, and a cap arranged to fit on to the base and to press down on the cable to force the probes through the cable insulation to make contact with the cable conductors and simultaneously press the cables into the recesses to provide a pressure-tight seal between the outer surface of the cable and the holder, characterized in that the cap has an unbroken rim, is non-deformable, and has an internal formation co-operable with a lug or lugs on the base to latch-fit for permanent fixing to the base in such a manner as to co-operate with the base and the cable to form a pressure-tight seal between the interior and exterior of the cap.

Preferably, the recesses are formed to accommodate substantially the whole of the cable and the cap is formed with a non-recessed base.

A separate peripheral seal may be fitted between the abutting surfaces of the cap and the base.

The recesses may be provided with upstanding lips to form line indentations in the outer circumference of the electrical cable to improve sealing between the holder and the cable.

Upstanding lips may be provided on the base around and between the probes.

The holder may be used with a trapezoidal or hemispherical (having a flat base) cable in cross-section, in which case the recesses are shaped such that the cap bears on the larger base of the trapezoid or hemisphere as the case may be, so that pressure applied to the cable is distributed from all sides of the recess.

Where conventional lighting cable is used which is generally rectangular in cross-section with rounded corners, the recesses in the base are preferably likeshaped and arranged to have a depth of at least about 75% of the natural depth of the cable.

The base may be shaped to receive a lamp globe with one or more seals to form a water-tight seal between the globe end of the base.

The globes are preferably formed of polycarbonate material which can also be conveniently tinted in selected colors. Glass, polystyrene and other translucent materials may be used where desired. For low voltage applications, the socket is preferably formed with probes which extend down through the body of the base and terminate with narrow female connectors to receive the conventional wire connectors of tungsten halogen lamps. The wire connectors are preferably crimped so that the lamp is held firmly in position when the holder is vibrated or orientated once the lamp is in position.

In a mains voltage form, the base may be formed with or provided with a bayonet or screw fitting for a mains voltage lamp.

In that case seal for the lamp is preferably mounted inside the housing below the bayonet or screw coupling so that a water seal is formed in use between the socket and the lamp below the lamp and socket connections.

The base and cap are preferably moulded from plastics material, such as nylon, ABS or polypropylene.

According to another aspect of the invention there is provided a festoon lighting system having a plurality of lamp holders separated and attached to an insulated electrical supply cable, each holder comprising a base, incorporating a lamp socket, having upstanding probes electrically connected to the lamp socket and formed with two opposing recesses, one at each side of the probes, shaped to receive the electrical supply cable which extends beyond the recesses and across the probes in use, and a cap arranged to fit on to the base and to press down on the cable to force the probes through the cable insulation to make contact with the cable conductors and simultaneously press the cables into the recesses to provide a pressure-tight seal between the outer surface of the cable and the holder, characterized in that the cap has an unbroken rim, is non-deformable, and has an internal formation co-operable with a lug or lugs on the base to latch-fit for permanent fixing to the base in such a manner as to co-operate with the base and the cable to form a pressure-tight seal between the interior and exterior of the cap.

The power cable may be trapezoidal in cross-section and the recesses shaped such that the cap bears on the larger base of the trapezoid.

BRIEF DESCRIPTION OF THE DRAWINGS

Embodiments of lamp holders according to the invention will now be described by way of example with reference to the accompanying drawings in which.

DESCRIPTION OF THE PREFERRED EMBODIMENTS

Figure 1:
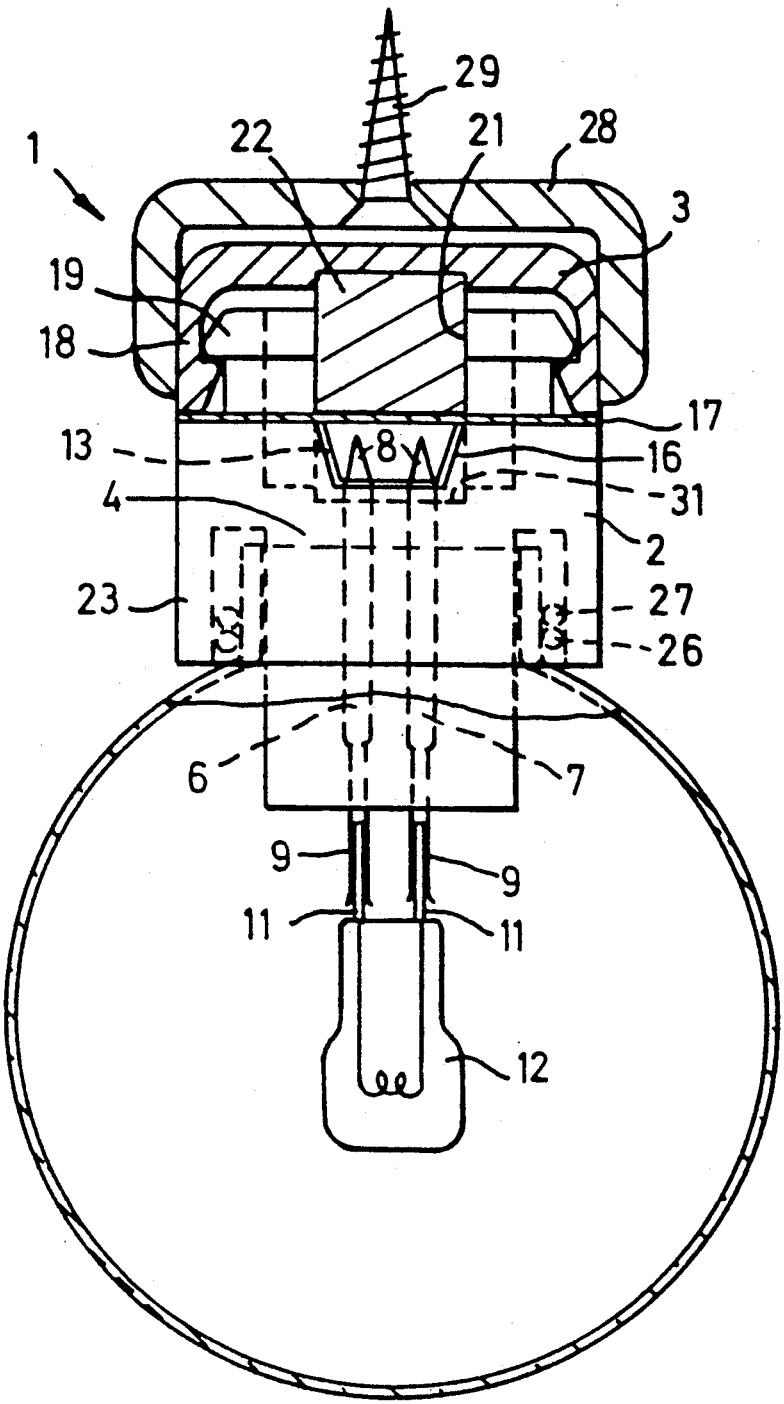
FIG. 1 is a partly sectioned front view of a first lamp holder.
Figure 2:
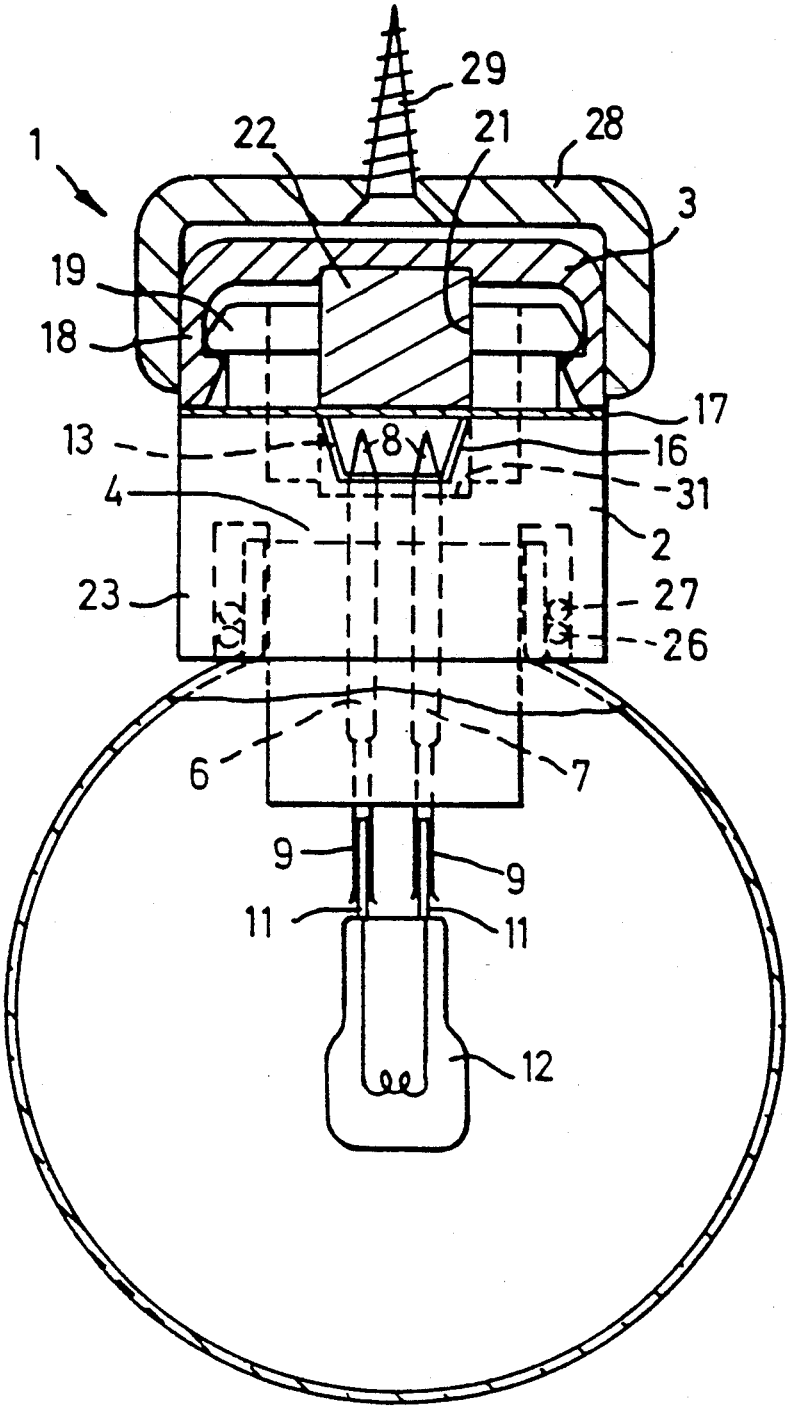
FIG. 2—There is nc FIG. 2 in the present application.

Referring to FIGS. 1 and 2, a circular lamp holder 1 for use with a 12 or 24 volt, electrical supply is shown having a base 2, and a cap 3 fitted in use to the base 2. No cable is shown in these figures. The base 2 and cap 3 are made from nylon. A lamp socket 4 comprising two electrical feed-throughs 6, 7, incorporated into the base 2, has two pointed upstanding probes 8. Each electrical feed through 6, 7 extends down through the body of the base 2 and terminates with a narrow female connector 9 to hold a wire connector 11 from a tungsten halogen lamp 12. The base 2 further has trapezoidal recesses 13 in the wall of the base 2 at either side of the probes 8. A centrally located triangular upstanding lip 16 extends around the periphery of each recess 13. A similar upstanding lip is provided on the underside of the outer wall of the cap 3 to form a water-tight seal together with a peripheral gasket 17 arranged to fit between the abutting surfaces of the cap 3 and the base 2.

The cap 3 and base 2 have co-operating lugs 18, 19 which form a snap-fit between the cap 3 and base 2. An aperture 21, for the cable, in the base 2 provides the co-operating lug in the base 2 with a degree of resiliency for the snap-fit which is permanent. A boss 22 is formed centrally within the cap 3.

The lamp socket 4 is surrounded by an integrally formed housing 23 extending from the base for receiving a plastics or glass globe 24. The globe 24 is held in place by one or two "0" rings 26, 27 which form a water-tight seal. The lamp holder 1 can be mounted to a fixed structure where required by attachment to a cylindrically shaped mountable clamp 28 made from PVC, having a fixing screw 29, into which the cap 3 may be press-fitted.

In use a twin core insulated electrical cable of complimentary shape to the recesses 13 is laid in a channel, extending between the recesses 13, in such a manner that the cores of the cable align with the probes 8. The cap 3 is then snap-fitted onto the base 2 and the boss 22 within the cap 3 presses down on the cable to force each probe 8 through the cable insulation to make contact with the respective cores. Simultaneously, the cable is pressed firmly into the recesses 13 to form a water-tight seal between the outer surface of the cable and the lamp holder 1. It will be noted that because the recesses 13 are trapezoidal the downward pressure of the cap tends to exert both downward pressure as well as sideways pressure on the exterior of the cable to urge the cable into good sealing contact around its whole periphery.

Inboard of and adjacent to the recesses 13, the base 2 is cut-away to some extent so that a small gap 31 is formed in use between the outer surface of the cable and the inner bearing surfaces of the base 2. This ensures good sealing between the cap 3 and the base 2 and the cable in the region of the recesses 13 by concentrating pressure applied to the cable within the region of the recesses.

Figure 3:
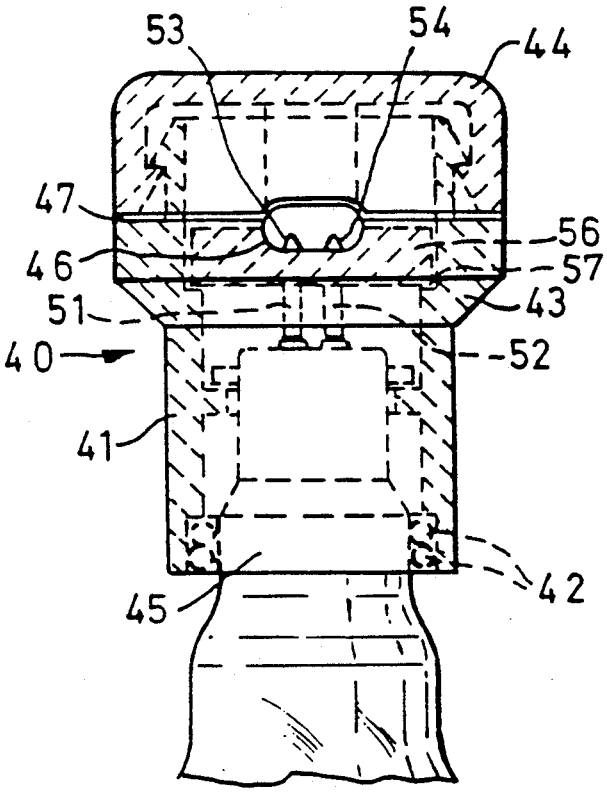
FIG. 3 is a partly sectioned front view of a second lamp holder.

Referring to FIG. 3, a circular lamp holder 40 for use with a mains electrical supply is shown, having a socket 41 in the form of a bayonet connector. The top of the base 43 and cap 44 are similar in construction to that of the low voltage lamp holder. A double "0" ring gasket 42, is used to form a water-tight seal between the lower inside surface of the base 43 and the base of the lamp 45. A standard mains double insulated cable (not shown) is rectangular with rounded corners, and complimentary shaped opposing recesses 46, are provided in the base 43 of the lamp holder 40. The depth of the recesses 46, in the base are at least 75% of the normal depth of the cable and the cap 44 has recesses to receive the other 25% of the cable. A gasket 47 is also provided to fit between the abutting surfaces of the base 43 and the cap 44.

The contacts 51, 52 are off-set from the central axis of the lamp holder 40, and they are sprung loaded at the lamp end with pointed probes 53, 54 for penetrating the cable insulation at the other end. The contacts 51, 52 are mounted within a separable insert 56 which is located within the base 43 on a circular shoulder 57.

Figure 4:
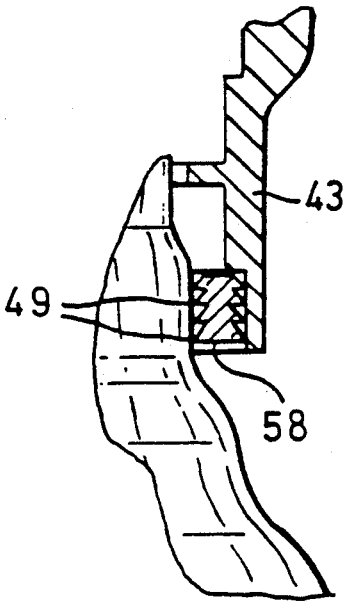
FIG. 4 is part of a sectioned front view of a third lamp holder.

In FIG. 4, a sawtooth shaped gasket 58, shown in cross-section is used to form a water-tight seal between the base 43 and the base of the lamp 45. In a further arrangement an Edison screw socket is used to replace the bayonet connector socket 41.

Figure 5:
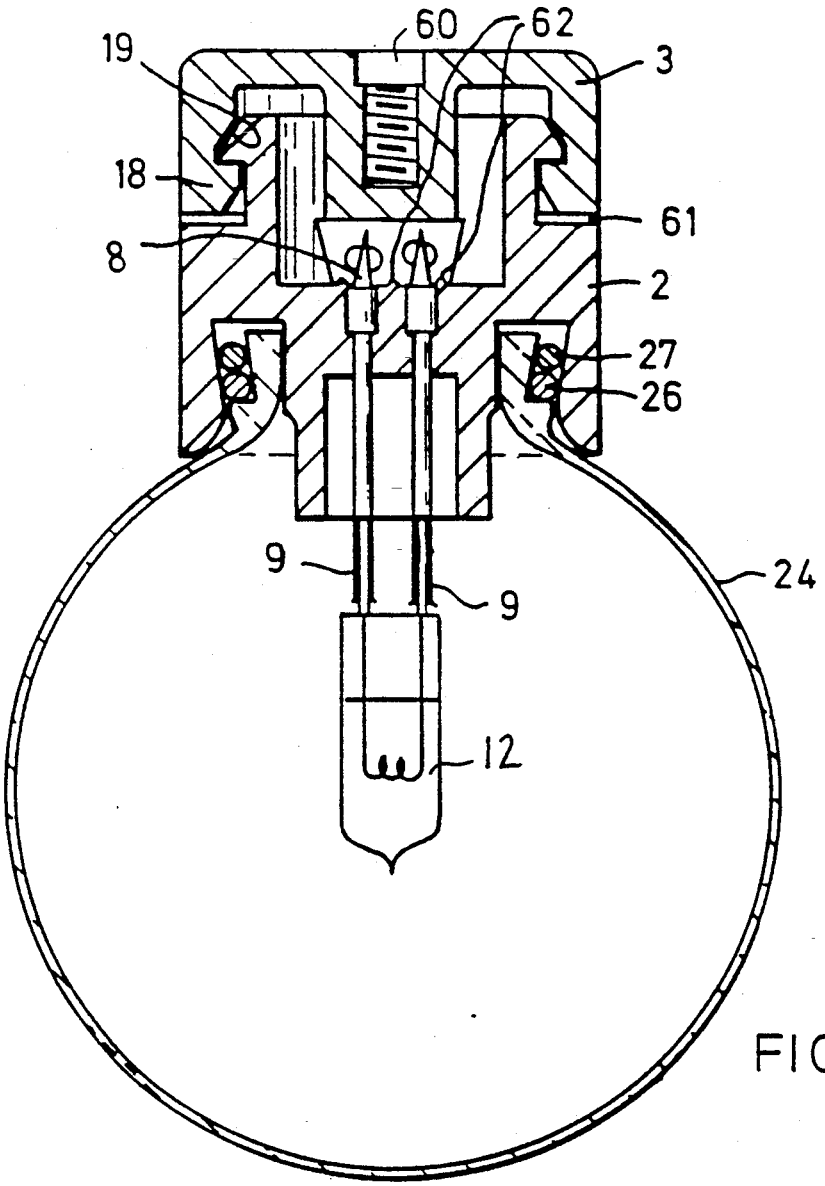
FIG. 5 is a sectioned front view of a further lamp holder similar to that shown in FIG. 1.
Figure 6:
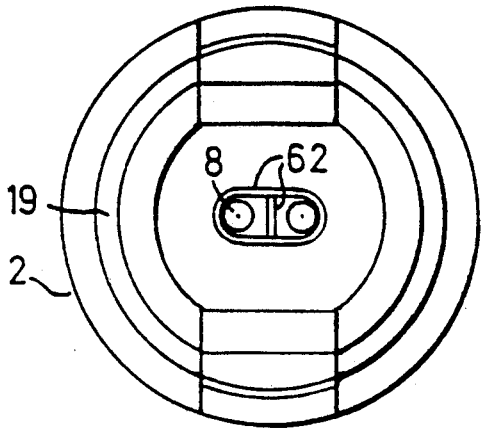
FIG. 6 is a top view of FIG. 5 with the cap and cable removed.

In FIGS. 5 and 6, certain differences to FIG. 1 are noted. The cap 3 is provided with a stepped blind hole 60 to accept a fixing screw (not shown). A peripheral neoprene gasket 61 provides a seal between the cap 3 and the base 2. In practice the gasket 61 is compressed to about half its natural thickness (compressed from 1 mm to 0.5 mm) which compression is carefully controlled by the configuration of the cooperating lugs 18,19.

The contact pins are formed of hard brass and extend to female connectors 9. The wire connectors of the lamp 12 are crimped to hold them in place in use. It will be noted that upstanding lips 62 are provided around and between the probes 8 to enhance the seal to be formed between the outer surface of the cable and the base 2.

It will be noted that the cap 3 fits to the base 2, when pressed on to the base towards the cable, because the lugs 19 can move to some extent inwards, being formed by an incomplete circle, to allow the lugs 18 to ride over and lock behind the lugs 19. The lugs 18 do not normally move outwards because the cap is made of generally rigid material and the lugs 18 are formed around a complete circle. Thus, when the cap 3 is fitted it snaps on, or better stated, latches on to the base 2 and remains permanently fixed to the base. The cap 3 cannot be removed without destruction of the holder but completes in use as explained a secure gas-tight seal to the electrical cable for the holder.

In FIG. 5 it can be seen that the neck of the globe 24 is carefully shaped and so is the bottom of the base 2. The cooperating adverse tapers on the globe and the base provide the facility of making it easier to fit the globe than to remove it. The globe can of course be removed for replacement of the bulb 12 if required. The seals 26 and 27 do render the connection between the globe and the base gas-tight so that replacement of the bulb is in any event much less frequently required than in normal circumstances. More importantly, the described holder can be used in hazardous environments (e.g. underground mines) or even under water because the exposed electrical components and the bulb are isolated from the environment by the sealing arrangements described.

Embodiments of the present invention provide lamp holders which are both water and pressure-tight i.e.

gas-tight. The life time of festoon lighting systems using these lamp holders is much improved, especially in areas such as seaside resorts, on board ships, bridges, piers or quays, as compared to present similar lighting systems which are available. The lamp holders are also extremely durable against both storm damage and against vandalism especially when the described globes are fitted. Most importantly the lamp holders cannot easily be disassembled which is necessary to satisfy to some wiring legislations concerning such lighting systems.

Figure 7:
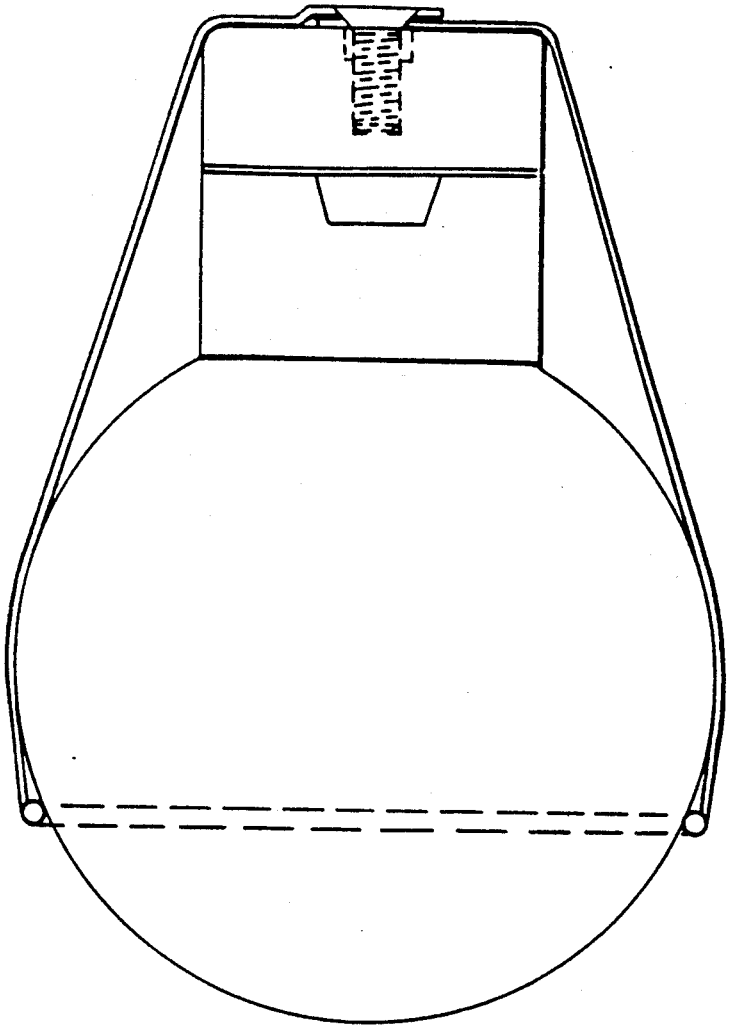
FIG. 7 is a front view of a lamp holder with a protective frame.

In FIG. 7, the globe is surrounded by a protective frame which is held in position by a screw in the cap 3. The frame prevents removal of the globe 24 which facility may be required to satisfy safety regulations where the festoon lighting system is used in hazardous environments for example where intrinsically safe systems are required.

The described lamp holders are easy to assemble, preferably by use of a clamp or press. Tungsten halogen lamps have an expected life of several thousand hours. The effective luminance of the system using five watt tungsten halogen lamps and polycarbonate globes is similar to a conventional incandescent mains voltage lamp at twentyfive watts, giving a power saving of approximately 66%. Furthermore, a safe low power lightweight festoon system aesthetically pleasing to the eye is provided. Finally, it is possible to use the lamp holders both for low voltage and mains voltage systems in an inverted orientation with the lamps uppermost, because they are water-tight, and because they are lightweight they are not susceptible to storm damage.

Figure 8:
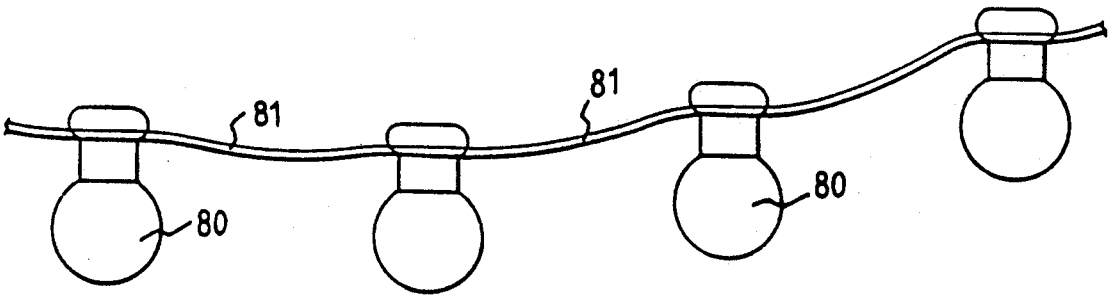
FIG. 8 is a schematic arrangement of part of a festoon lighting system.

FIG. 8 shows part of a festoon lighting system having a number of lamps 80 permanently attached to an electrical power supply cable 81.

I claim:

1. A lamp holder comprising a base, incorporating a lamp socket, having upstanding probes electrically connected to the lamp socket and formed with two opposing recesses, one at each side of the probes, shaped to receive an insulated electrical supply cable which extends beyond the recesses and across the probes in use, and a cap arranged to fit on to the base and to press down on the cable to force the probes through the cable insulation to make contact with cable conductors and simultaneously press the cable into the recesses to provide a pressure-tight seal between the outer surface of the cable and the holder, characterized in that the cap has an unbroken rim, is non-deformable, and has an internal formation co-operable with a lug or lugs on the base to latch-fit for permanent fixing to the base in such a manner as to co-operate with the base and the cable to form a pressure-tight seal between the interior and exterior of the cap.

2. A holder according to claim 1, incorporating a separate peripheral seal fitted between the abutting surfaces of the cap and the base.

3. A holder according to claim 1, in which the recesses are provided with upstanding lips to form line indentations in the outer circumference of the electrical cable to improve sealing between the holder and the cable.

4. A holder according to claim 1, in which upstanding lips are provided on the base around and between the probes.

5. A holder according to claim 1, for use with a trapezoidal or hemispherical (having a flat base) cable in cross-section, in which the recesses respectively are shaped such that the cap bears on the larger base of the trapezoid or hemisphere as the case may be, so that pressure applied to the cable is distributed from all sides of the recesses.

6. A holder according to claim 1, in which the base is shaped to receive a lamp globe with one or more seals to form a water-tight seal between the globe and the base.

7. A holder according to claim 6, having a globe fitted thereto formed of glass, or polycarbonate or polystyrene material.

8. A festoon lighting system having a plurality of lamp holders separated and attached to an insulated electrical supply cable, each holder comprising a base, incorporating a lamp socket, having upstanding probes electrically connected to the lamp socket and formed with two opposing recesses, one at each side of the probes, shaped to receive an insulated electrical suply cable which extends beyond the recesses and across the probes in use, and a cap arranged to fit on to the bae and to press down on the cable to force the probes through the cable insulation to make contact with cable conductors and simultaneously press the cable into the recesses to provide a pressure-tight seal between the outer surface of the cable and the holder, characterized in that the cap has an unbroken rim, is non-deformable, and has an internal formation co-operable with a lug or lugs on the base to latch-fit for permanent fixing to he base in such a manner as to co-operate with the base and the cable to form a pressure-tight seal between the interior and exterior of the cap.

9. A festoon lighting system according to claim 8, in which the power cable is trapezoidal in cross-section and the recesses ar shaped such that the cap bears on the larger base of the trapezoid.

* * * * *